United States Patent [19]

Vanier et al.

[11] Patent Number: 4,716,145

[45] Date of Patent: Dec. 29, 1987

[54] NON-IMAGEWISE REHEATING OF TRANSFERRED DYES IN THERMAL DYE TRANSFER ELEMENTS

[75] Inventors: Noel R. Vanier, Rochester; Gary W. Byers; Helmut Weber, both of Webster, all of N.Y.

[73] Assignee: Eastman Kodak Company, Rochester, N.Y.

[21] Appl. No.: 879,690

[22] Filed: Jun. 27, 1986

[51] Int. Cl.[4] ..... B41M 5/26

[52] U.S. Cl. ..... 503/227; 8/471; 427/146; 427/256; 428/195; 428/480; 428/913; 428/914; 430/945

[58] Field of Search ..... 8/470, 471; 427/256, 427/146; 428/195, 207, 913, 914, 480; 430/945; 346/227, 206

[56] References Cited

U.S. PATENT DOCUMENTS

| | | | |
|---|---|---|---|
| 3,952,131 | 4/1976 | Sideman | 428/914 |
| 4,021,591 | 5/1977 | DeVries et al. | 428/914 |
| 4,201,821 | 5/1980 | Fromson et al. | 428/203 |
| 4,314,813 | 2/1982 | Masaki | 8/471 |
| 4,522,881 | 6/1985 | Kobayashi et al. | 8/471 |

FOREIGN PATENT DOCUMENTS

| | | | |
|---|---|---|---|
| 97493 | 1/1984 | European Pat. Off. | 8/471 |
| 0138483 | 4/1985 | European Pat. Off. | 428/913 |
| 59-222389 | 12/1984 | Japan | 8/471 |
| 0076391 | 4/1985 | Japan | 428/488.1 |
| 60-115485 | 6/1985 | Japan | 8/471 |
| 60-125697 | 7/1985 | Japan | 8/471 |

*Primary Examiner*—Bruce H. Hess
*Attorney, Agent, or Firm*—Harold E. Cole

[57] ABSTRACT

A dye-donor element is described which contains an area which does not contain any image dye. A receiving element containing thermally transferred image dyes is reheated by a thermal print head with an area of the dye-donor which does not contain any dye located therebetween. Stratification of the transferred image dye in the receiver is thereby reduced.

17 Claims, No Drawings

NON-IMAGEWISE REHEATING OF TRANSFERRED DYES IN THERMAL DYE TRANSFER ELEMENTS

This invention relates to thermal dye transfer, and more particularly to a dye-donor element which contains an area which does not contain any image dye which is used in a process of reheating the transferred image dye in the receiving element. Stratification of the transferred image dye in the receiver is thereby reduced.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986 the disclosure of which is hereby incorporated by reference.

The thermal transfer system described above utilizes differentially applied heating power for image discrimination. This means that low density image areas are heated less than high density areas in order to transfer less dye from the dye-donor element to the dye-receiving element. Since the time of heating is very short (generally less than 5 msec), thermal equilibrium is usually not attained. Thus a thermal gradient exists, the lower depths of the dye-receiving layer being less heated than near the exterior surface. These inherent factors of thermal dye transfer printing can lead to various problems.

One problem that has developed with the above-described thermal transfer system is that dye stratifies at the exterior surface of the dye-receiving layer. This is especially evident in lower density areas where the dye appears to be primarily near the surface of the dye-receiving layer. This dye stratification leads to light stability problems and the possibility of "retransferring" the dye to another undesired surface. Extreme stratification can also lead to changes in the covering power of the dye and may even give the dye an undesirable appearance of a metallic, golden sheen.

U.S. Pat. No. 4,522,881 relates to the use of a protective layer on a thermal print to avoid a color fading problem. The background art section of this patent indicates that after the printing step, "the printing paper has to be heated again to thereby perform the thermal diffusion of the dye into the printing paper". However, there is no indication as to how the printing paper is to be heated again or what heating equipment is to be used.

In Japanese patent publication No. 59/222389, there is a disclosure of the use of a heat-polymerizable resin material. After dye transfer, the material is apparently heated again to polymerize the resin material. Here again, there is no indication as to how this material is to be heated or what heating equipment is to be used.

In Japanese patent publication No. J60/125697, a thermal printing device is illustrated which reheats an ink sheet immediately before separating the sheet from the recording paper. A separate heating device from the thermal print head is illustrated for this purpose.

In European patent application No, 97,493, an additional set of rollers is illustrated to thermally "fix" the image after the dye transfer step. Here again, a separate heating device from the thermal print head is required to perform this heating step.

In Japanese patent publication No. J60/115485, a heat-sensitive transfer recording material is described which has a dye layer on one side and a "thermal head cleaning device" on the other side in a certain area thereof. In the particular area where the "thermal head cleaning device" is located, there is no dye material. There is no disclosure in this publication, however, about reheating the material in order to reduce stratification or that the "thermal head cleaning device" can function as a slipping layer.

It would be desirable to provide a way to reduce dye stratification in thermal dye transfer system in order to avoid the problems discussed above and which would not require the use of special equipment to carry out such a procedure.

Thus in accordance with this invention, a dye-donor element for thermal dye transfer is provided which comprises a support having thereon at least one area comprising a layer of an image dye dispersed in a binder, and wherein the element also contains at least one area which does not contain any image dye and which is approximately equl in size to one of the areas of the element which contains an image dye, and wherein the side of the support of the dye-donor element opposite the side having thereon the dye layer is coated with a slipping layer comprising a lubricating material.

The above-described dye-donor element is used to form a stable dye transfer image by imagewise-heating the element using a thermal print head, transferring a dye image to a dye-receiving element, and then heating the dye-receiving element containing the transferred image dye with the thermal print head, while an area of the dye-donor element that does not contain any image dye is located between the thermal print head and the dye-receiving element. By employing this technique, stratification of the transferred image dye in the dye-receiving element is thereby reduced without having to employ additional heating equipment.

The length of time for the additional reheating "pass" described above is not critical. It can easily be determined by one skilled in the art. If desired, two or more reheating "passes" could also be employed.

In a preferred embodiment of the invention, the dye-donor element is a multicolor element and comprises repeating units of four areas comprising layers of yellow, magenta and cyan image dyes, respectively, dispersed in a binder, and a "blank" area which does not contain any image dye.

In another preferred embodiment of the invention, the dye-donor element is a monochrome element and comprises repeating units of two areas, the first area comprising a layer of one image dye dispersed in a binder, and the second area comprising the "blank" area which does not contain any image dye.

In another preferred embodiment of the invention, the dye-donor element is a black-and-white element and comprises repeating units of two areas, the first area comprising a layer of a mixture of image dyes dispersed in a binder to produce a neutral transferred dye image, and the second area comprising the "blank" are which does not contain any image dye.

A dye-barrier layer may be employed in the dye-donor elements of the invention to improve the density of the transferred dye. Such dye-barrier layer materials include hydrophilic materials such as those described and claimed in Application Ser. No. 813,294 entitled "Dye-Barrier Layer for Dye-Donor Element Used in Thermal Dye Transfer" by Vanier, Lum and Bowman, filed Dec. 24, 1985.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

(magenta A)

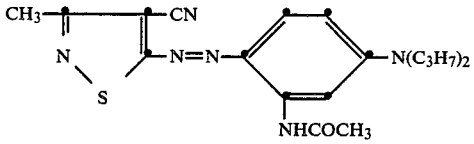

(yellow B)

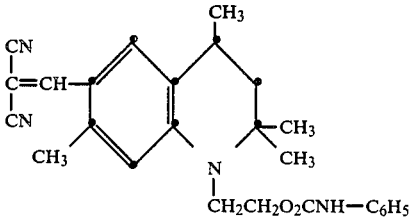

-continued (cyan C)

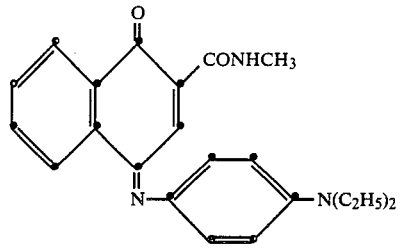

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye donoe element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrena, polyethylene, polyopropylene or methylpentane polymers; and polyimides such as polyimide-amides and polyetherimides. The support generally has a thickness of from about 2 to about 30 μm. It may also be coated with a subbing layer, if desired.

The reverse side of the dye-donor element is coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chlorids, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 $g/m^2$.

The dye-donor element of the invention may be used in sheet form or in a continuous roll or ribbon. If a continuous roll or ribbon is employed, it may have only one dye thereon or may have alternating areas of different dyes, such as sublimable cyan, magnets, yellow, black, etc., as disclosed in U.S. Pat. No. 4,541,830, and the "blank" area as discussed above. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and a "blank" area as discussed above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. The reheating step described above may be done after each color is transferred, or may be done one or more times after all the dyes have been transferred.

The following examples are provided to illustrate the invention.

EXAMPLE 1

Light Fade Test With Multicolor Element (A) A yellow dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (0.19 $g/m^2$), (2) A yellow dye layer containing yellow dye B as identified above (0.27 $g/m^2$) in a binder of cellulose acetate (40% acetyl) (0.32 $g/m^2$) coated from an acetone /2-butanone solvent mixture. On the back side of the element was coated a slipping layer of poly(vinyl stearate) (0.30 $g/m^2$) in a poly(vinyl alcohol-co-butyral) binder (0.45 $g/m^2$) from a tetrahydrofuran solvent.

(B) A magenta dye-donor element was prepared as (A) except that the dye layer contained magneta dye A as identified above (0.22 $g/m^2$) in a binder of cellulose acetate hydrogen phthalate (18–21% acetyl, 32–36% phthalyl) (0.38 $g/m^2$) from an acetone/2-butanone solvent mixture.

(C) A cyan dye-donor element was prepared as A) except that the dye layer contained cyan dye C as identified above (0.37 $g/m^2$) in a binder of cellulose acetate hydrogen phthalate (18–21% acetyl, 32–36% phthalyl) (0.42 $g/m^2$) from an acetone/2-butanone solvent mixture.

(D) A blank donor element was prepared as (A) except that there was no dye layer (2) coated on the dye-barrier layer (1).

A dye-receiving element was prepared by coating a solution of Makrolon 5705® (Bayer AG Corporation) polycarbonate resin (2.9 $g/m^2$) in a methylene chloride and trichloroethylene solvent mixture on an ICI Melinex 990® white polyester support.

The dye side of a dye-donor element (either yellow, magenta, or cyan) was placed in contact with the dye image-receiving layer of the dye-receiver element 1.5 inches (38 mm) wide. The assemblage was fastened in the jaws of a stepper motor driven pulling device. The assemblage was laid on top of a 0.55 inch (14 mm) diameter rubber roller and a Fujitsu Thermal Head (FTP-040MCS001) was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive element in the thermal print head were heated at 0.5 msec increments from 0 to 4.5 msec to generate a graduated density test pattern. The voltage supplied to the print head was approximately 19 v representing approximately 1.75 watts/dot.

To serve as a control, each dye-receiving element was separated from each dye-donor element and the Status A red, blue, and green reflection density of each stepped image was read. Each image was then subjected to the following fading test for 4 days: 50 kLux, 5400° K., 32° C. at approximately 25% RH. The densities were than read again. The percent density losses at steps 9, 7 and 4 were calculated for each dye.

To demonstrate the reheating concept of the invention, the above procedure was repeated, except that after separating the dye-receiving element from the dye-donor element, the dye-receiving element was placed in contact with the barrier layer side of the blank donor element. Uniform reheating of the entire ares of the stepped image on the receiver was done at the full-power setting (i.e., that which was used originally to provide maximum dye density) in the manner described above. The receiver was then separated from the blank donor element and the reflection density before and after the fading test was determined as before.

The following results were obtained:

TABLE 1

| Element | Reheating | Step 9 Init. Dens. | Step 9 % Loss After Fade | Step 7 Init. Dens. | Step 7 % Loss After Fade | Step 4 Init. Dens. | Step 4 % Loss After Fade |
|---|---|---|---|---|---|---|---|
| yellow | no (control) | 1.4 | 21 | 0.90 | 25 | 0.23 | 57 |
| yellow | yes | 1.5 | 8 | 1.0 | 7 | 0.20 | 12 |
| magneta | no (control) | 1.5 | 8 | 1.0 | 11 | 0.27 | 28 |
| magneta | yes | 1.5 | 4 | 1.1 | 5 | 0.32 | 5 |
| cyan | no (control) | 1.6 | 7 | 1.0 | 10 | 0.29 | 26 |
| cyan | yes | 1.6 | 5 | 1.1 | 6 | 0.32 | 9 |

The above results indicate that reheating the dye-receiving element in accordance with the invention utilizing a second uniform heat pass using a blank donor element significantly reduces the dye light-fade for all three dyes tested. The improvement of the dye's stability to light is proportionally greater in the low density areas (step 4) where the original heating for transferring the dye is the lowest.

EXAMPLE 2

Light Fade Test With Monochrome Element

The yellow and cyan dye-donor elements of Example 1 were processed as in Example 1 except that the resistive elements in the thermal print head were heated for 3.5 msec to generate a dye density near 1.0.

The following evaluations were all done by generation of green images. In one series, the yellow dye-donor element was imaged to the dye-receiving element first, followed by imaging of the cyan dye-donor element to form the green image. To serve as a control, the dye-receiving element was separated from each dye-donor element and the Status A red and blue reflection density was read. Each image was then subjected to the fade test as in Example 1. The densities were then read again and the percent blue and red density losses were calculated.

To demonstrate the reheating concept of the invention, the dye-receiving element was separated from the dye-donor element, placed in contact with the blank donor element and reheated as described in Example 1. Reheating using the thermal head was done for 3.5 msec (equivalent to step 7 for providing a dye density near 1.0). In another set, the reheating was repeated. After reheating, the elements were subjected to the dye fade test as described in Example 1.

In a second series, the yellow dye was imaged first, followed by either one or two reheating using the blank donor element, finally transferring the cyan dye to form the green image. Unlike the first series where both the yellow and cyan dyes experienced one or two reheatings with the blank donor element, in this series only the yellow dye was reheated once or twice.

The following results were obtained:

TABLE 2

| Series | Reheating | Yellow Init. Dens. | Yellow % Loss After Fade | Cyan Init. Dens. | Cyan % Loss After Fade |
|---|---|---|---|---|---|
| 1* | no (control) | 0.84 | 14 | 1.03 | 52 |
| | once | 0.93 | 13 | 1.09 | 38 |
| | twice | 0.88 | 11 | 1.05 | 33 |
| 2** | no (control) | 0.80 | 15 | 1.01 | 50 |
| | once | 0.91 | 9 | 1.03 | 42 |
| | twice | 0.91 | 6 | 0.92 | 39 |

*Yellow dye transferred first, followed by cyan dye transfer, then reheating.
**Yellow dye transferred first, followed by reheating, then cyan dye transfer.

The above results indicate an improvement in stability to light of the dyes of both series. The first series was relatively more beneficial to the cyan dye because it was also reheated in addition to the yellow dye. Even though the cyan dye was not reheated in the second series, cyan dye fade was still lessened. This could have occurred because upon reheating, the yellow dye might be driven deeper into the dye-receiving layer so that less transferred cyan dye would be in close proximity to the yellow dye, thereby minimizing dye-dye interactions.

When the above experiment was repeated but transferring the cyan dye first followed by the yellow dye, similar improvements were obtained.

EXAMPLE 3

Light Fade Test With Black-and-White Element

A neutral dye-donor element was prepared similar to A) of Example 1 except that the dye layer was a mixture of yellow dye B (0.22 g/m$^2$), magenta dye A (0.15 g/m$^2$), and cyan dye C (0.34 g/m$^2$) as identified above and dispersed in a cellulose acetate hydrogen phthalate binder (0.42 g/m$^2$) coated from a 2-butanone, cyclohexanone, and acetone solvent mixture.

A blank donor element and dye-receiving element were prepared as in Example 1.

A neutral image at maximum density was obtained by a single pass heating of the neutral dye-donor element similar to the procedure described in Example 1 except that the resistive elements in the thermal print head were heated for 3.5 msec.

To serve as a control, the dye-receiving element was separated from the neutral dye-donor element and the Status A red, blue, and green reflection densities of the neutral image was read. The image was then subjected to a fade test as described in Example 1. The densities were then read again. The percent density losses were calculated.

To demonstrate the reheating concept of the invention, the above procedure was repeated, except that after separating the dye-receiving element from the dye-donor element, the dye-receiving element was placed in contact with the barrier layer side of the blank donor element. Uniform reheating of the image on the receiver was done either once or twice for 3.5 mssc using the thermal head as described in Example 2. The receiver was then separated from the blank donor element and the reflection density before and after the fading test was determined as before.

The following results were obtained:

TABLE 3

| | | Yellow | | Magneta | | Cyan | |
|---|---|---|---|---|---|---|---|
| Element | Reheating | Init. Dens. | % Loss After Fade | Init. Dens. | % Loss After Fade | Init. Dens. | % Loss After Fade |
| neutral | no (control) | 0.82 | 22 | 0.86 | 19 | 0.84 | 50 |
| neutral | once | 0.86 | 10 | 0.90 | 2 | 0.88 | 28 |
| neutral | twice | 0.84 | 6 | 0.89 | 6 | 0.88 | 21 |

The above results indicate that reheating the neutral image transferred from a single neutral dye-donor element provided an improvement in stability of all three dyes to light. Reheating a second time gave a further stability improvement of the yellow and cyan dyes.

EXAMPLE 4

Dye Retransfer Test

A magenta dye-donor element and dye-receiving element were prepared as in Example 1. A blank donor element was prepared as in Example 1 except that a layer of cellulose acetate (40% acetyl) (0.32 g/m$^2$) was coated on top of the dye-barrier layer.

A magenta image was transferred using the procedure of Example 1. After transfer, the dye-receiving element was separated from the magenta dye donor and was placed in contact with the barrier layer side of the blank donor element. Uniform reheating of the entire stepped image on the dye-receiving element at the full-power setting was performed and the dye-receiving element was separated. As a control, the stepped image of the receiver was not subjected to the reheat cycle.

A test was then performed to measure the propensity of the transferred dye in the dye-receiving layer to subsequently transfer to another surface. This unwanted transfer of dye is commonly known in the art as "retransfer". The face of each dye-receiving element was taped with pressure to the front of a waterproof poly(ethylene)-titanium dioxide overcoated reflective paper support and incubated for three days at 49° C., 50% RH. The extent of dye retransferred to the reflective support was measured by reading the green Status A density corresponding to the highest density step. The following results were obtained:

| Element | Status A Retransfer Density | |
|---|---|---|
| Control | 0.15 (background = 0.08) | 0.07 net transfer |
| Reheated | 0.10 (background = 0.08) | 0.02 net transfer |

The above results show that reheating the dye-receiving element substantially reduces the amount of dye retransferred. The control element showed a clearly visible stepped retransferred image. On the other hand, the retransferred image of the dye receiving element of the invention which was reheated, was not easily detectable.

The invention has been described in detail with particular references to preferred embodiments thereof, but it will be understood that variations and modifications can be effected within the spirit and scope of the invention.

What is claimed is:

1. In a dye donor element for thermal dye transfer comprising a support having thereon at least one continuous area comprising a layer of an image dye dispersed in a binder, the improvement wherein said element also contains at least one continuous area which does not contain any image dye and which is approximately equal in size to one of the areas of said element which contains an image dye, said continuous area which does not contain any image dye enabling said dye donor element to be used to heat a dye-receiving element containig a transferred dye image to reduce stratification, and wherein the side of the support of the dye-donor element opposite the side having thereon said dye layer is coated with a slipping layer comprising a lubricating material.

2. The element of claim 1 wherein said dye-donor element comprises repeating units of four continuous areas comprising layers of yellow, magents and cyan image dyes, respectively, dispersed in a binder, and said area which does not contain any image dye.

3. The element of claim 1 wherein said dye-donor element comprises repeating units of two continuous areas, said first area comprising a layer of one image dye dispersed in a binder, and said second area comprising said area which does not contain any image dye.

4. The element of claim 1 wherein said dye-donor element comprises repeating units of two continuous areas, said first area comprising a layer of a mixture of image dyes dispersed in a binder to produce a neutral transferred dye image, and said second area comprising said area which does not contain any image dye.

5. The element of claim 1 wherein said dye is a sublimable dye.

6. The element of claim 1 wherein said support comprises poly(ethylene terephthalate).

7. In a process of forming a stable dye transfer image comprising imagewise-heating a dye-donor element comprising a support having thereon at least one continuous area comprising a layer of an image dye dispersed in a binder, and transferring a dye image to a dye-receiving element to form said dye transfer image, said imagewise-heating being done by a thermal print head, the improvement comprising heating said dye-receiving element containing said transferred dye image with said thermal print head while a continuous area of said dye-donor element that does not contain any image dye is located between said thermal print head and said dye-receiving element containing said transferred image dye, so that stratification of said transferred image dye in said dye-receiving element is reduced.

8. The process of claim 7 wherein said dye-donor element comprises repeating units of four continuous areas comprising layers of yellow, magenta and cyan image dyes, respectively, dispersed in a binder, and said area which does not contain any image dye.

9. The process of claim 7 wherein said dye-donor element comprises repeating units of two continuous areas, said first area comprising a layer of one image dye dispersed in a binder, and said second area comprising said area which does not contain any image dye.

10. The process of claim 7 wherein said dye-donor element comprises repeating units of two continuous areas, said first area comprising a layer of a mixture of image dyes dispersed in a binder to produce a neutral transferred dye image, and said second area comprising said area which does not contain any image dye.

11. The process of claim 7 wherein the side of the support of the dye-donor element opposite the side having thereon said dye layer is coated with a slipping layer comprising a lubricating material.

12. In a thermal dye transfer assemblage comprising:

a) a dye-donor element comprising a support having thereon at least one continuous area comprising a layer of an image dye dispersed in a binder, and b) a dye-receiving element comprising a support having thereon a dye image-receiving layer, said dye receiving element being in a superposed relationship with said dye-donor element so that said dye layer is in contact with said dye image-receiving layer, the improvement wherein sid dye donor element also contains at least one continuous area which does not contain any image dye and which is approximately equal in size to one of the areas of said dye donor element which contains an image dye, said continuous area which does not contain any image dye enabling said dye-donor element to be used to heat said dye-receiving element after thermal dye transfer processing to reduce stratification of a transferred dye image, and wherein the side of the support of the dye-donor element opposite the side having thereon said dye layer is coated with a slipping layer comprising a lubricating material.

13. The assemblage of claim 12 wherein said dye-donor element comprises repeating units of four continuous areas comprising layers of yellow, magenta and cyan image dyes, respectively, dispersed in a binder, and said area which does not contain any image dye.

14. The assemblage of claim 12 wherein said dye-donor element comprises repeating units of two continuous areas, said first area comprising a layer of one image dye dispersed in a binder, and said second area comprising said area which does not contain any image dye.

15. The assemblage of claim 12 wherein said dye-donor element comprises repeating units of two continuous areas, said first area comprising a layer of a mixture of image dyes dispersed in a binder to produce a neutral transferred dye image, and said second area comprising said area which does not contain any image dye.

16. The assemblage of claim 12 wherein said dye is a sublimable dye.

17. The assemblage of claim 12 wherein said support of said dye donor element comprises poly(ethylene terephthalate).

* * * * *